US007621058B2

(12) United States Patent
Durand

(10) Patent No.: US 7,621,058 B2
(45) **Date of Patent: *Nov. 24, 2009**

(54) SOLE WITH EXTENSIBLE STRUCTURE

(75) Inventor: Jean-Jacques Durand, Cholet (FR)

(73) Assignee: Exten.s, Cholet (FR)

( * ) Notice: Subject to any disclaimer, the term of this patent is extended or adjusted under 35 U.S.C. 154(b) by 34 days.

This patent is subject to a terminal disclaimer.

(21) Appl. No.: 11/603,150

(22) Filed: Nov. 22, 2006

(65) Prior Publication Data

US 2007/0062069 A1 Mar. 22, 2007

Related U.S. Application Data

(63) Continuation of application No. 10/475,933, filed as application No. PCT/FR02/01366 on Apr. 22, 2002, now Pat. No. 7,155,845.

(30) Foreign Application Priority Data

Apr. 27, 2001 (FR) ..... 01 05702

(51) Int. Cl.
*A43B 3/26* (2006.01)

(52) U.S. Cl. ..... 36/97; 36/25 R; 36/30 R

(58) Field of Classification Search ..... 36/97, 36/25 R, 30 R, 28, 31, 130, 43, 44
See application file for complete search history.

(56) References Cited

U.S. PATENT DOCUMENTS 997,657 A * 7/1911 Drake ..... 36/129
2,211,509 A * 8/1940 Lumbard ..... 36/43
2,252,315 A 8/1941 Doree
2,931,110 A 4/1960 Pietrocola
3,161,970 A * 12/1964 Purtell ..... 36/43

(Continued)

FOREIGN PATENT DOCUMENTS

EP 0401108 A1 5/1990

(Continued)

OTHER PUBLICATIONS

U.S. Appl. No. 60/304,250, filed Jul. 10, 2001.

(Continued)

*Primary Examiner*—Ted Kavanaugh
(74) *Attorney, Agent, or Firm*—Westerman, Hattori, Daniels & Adrian, LLP

(57) ABSTRACT

Sole with stretchable structure, a footwear article provided with such a sole and its assembly method.

The invention relates to a footwear sole where the forepart is associated with a stretchable material making it possible to fit differing foot widths easily; it also relates to the footwear equipped with such a sole and the method for mounting this footwear.

It is constituted of a sole base (1) comprising openings (4) in which the lugs (3) of the stretchable part (2) are positioned in a seared manner.

The insole (5) comprises a deformable structure (6) in its forepart. When the wearer's foot is put into a footwear article provided with such a complex, it exerts pressure on the edges of the upper (10) thus causing deformation of the sole This ability of deforming the sole avoids feelings of compression of the foot The device according to the invention is intended in particular for the manufacture of footwear with the ability of adapting to differing foot anatomies.

25 Claims, 3 Drawing Sheets

U.S. PATENT DOCUMENTS

| | | | | |
|---|---|---|---|---|
| 3,591,879 | A | | 7/1971 | Stapleton |
| 3,609,888 | A | | 10/1971 | Rickman |
| 3,624,930 | A | | 12/1971 | Johnson et al. |
| 3,629,961 | A | | 12/1971 | Seif |
| 3,705,463 | A | | 12/1972 | Lown |
| 3,724,105 | A | | 4/1973 | Weight |
| 3,748,756 | A | | 7/1973 | White |
| 3,834,046 | A | | 9/1974 | Fowler |
| 3,916,539 | A | | 11/1975 | Pankin et al. |
| 3,952,430 | A | | 4/1976 | Pankin et al. |
| 4,215,493 | A | | 8/1980 | Antonious |
| 4,270,285 | A | | 6/1981 | Antonious |
| 4,451,995 | A | | 6/1984 | Antonious |
| 4,506,460 | A | | 3/1985 | Rudy |
| 4,541,184 | A | | 9/1985 | Leighton |
| 4,551,930 | A | | 11/1985 | Graham et al. |
| 4,559,723 | A | | 12/1985 | Hamy et al. |
| 4,559,724 | A | | 12/1985 | Norton |
| 4,590,123 | A | | 5/1986 | Hashimoto et al. |
| 4,599,810 | A | | 7/1986 | Sacre |
| 4,654,983 | A | | 4/1987 | Graham et al. |
| 4,658,516 | A | | 4/1987 | Beck |
| 4,724,624 | A | | 2/1988 | Duclos |
| 4,910,887 | A | | 3/1990 | Turner et al. |
| 4,944,099 | A | | 7/1990 | Davis |
| 4,967,492 | A | | 11/1990 | Rosen |
| 5,025,573 | A | | 6/1991 | Giese et al. |
| 5,060,402 | A | | 10/1991 | Rosen |
| 5,203,097 | A | | 4/1993 | Blair |
| 5,337,492 | A | | 8/1994 | Anderie et al. |
| 5,367,791 | A | * | 11/1994 | Gross et al. ..... 36/31 |
| 5,367,792 | A | | 11/1994 | Richard et al. |
| 5,423,135 | A | | 6/1995 | Poole et al. |
| 5,499,459 | A | | 3/1996 | Tomaro |
| 5,529,830 | A | | 6/1996 | Dutta et al. |
| 5,555,650 | A | | 9/1996 | Longbottom et al. |
| 5,566,475 | A | | 10/1996 | Donnadieu |
| 5,659,914 | A | | 8/1997 | Steinlauf |
| 5,725,823 | A | | 3/1998 | Finn et al. |
| 5,727,271 | A | | 3/1998 | Romanato et al. |
| 5,729,912 | A | | 3/1998 | Gutkowski et al. |
| 5,765,296 | A | | 6/1998 | Ludemann et al. |
| 5,804,011 | A | | 9/1998 | Dutta et al. |
| 5,813,145 | A | | 9/1998 | Prober |
| 5,815,949 | A | | 10/1998 | Sessa |
| 5,829,171 | A | | 11/1998 | Weber et al. |
| 5,879,725 | A | | 3/1999 | Potter |
| 5,893,219 | A | | 4/1999 | Smith et al. |
| 5,915,820 | A | | 6/1999 | Kraeuter et al. |
| 5,940,990 | A | | 8/1999 | Barret |
| 5,946,825 | A | | 9/1999 | Koh et al. |
| 5,948,707 | A | | 9/1999 | Crawley et al. |
| 5,956,868 | A | | 9/1999 | Stevens et al. |
| 5,983,524 | A | | 11/1999 | Polegato |
| 5,996,253 | A | | 12/1999 | Spector |
| 6,029,376 | A | | 2/2000 | Cass |
| 6,050,001 | A | | 4/2000 | Ditrtrich |
| 6,065,230 | A | | 5/2000 | James |
| 6,105,279 | A | | 8/2000 | Bouchoms |
| 6,115,945 | A | | 9/2000 | Ellis, III |
| 6,119,373 | A | | 9/2000 | Gebhard et al. |
| 6,122,844 | A | | 9/2000 | Nunez |
| 6,138,385 | A | | 10/2000 | Jungkind et al. |
| D433,560 | S | | 11/2000 | Pawlus |
| 6,205,683 | B1 | | 3/2001 | Clark et al. |
| 6,421,933 | B1 | | 7/2002 | Zamprogno |
| 6,519,876 | B1 | | 2/2003 | Geer et al. |
| 6,920,707 | B1 | | 7/2005 | Greene et al. |
| 6,976,319 | B2 | | 12/2005 | Pfander |
| 7,155,845 | B2 | * | 1/2007 | Durand ..... 36/97 |
| 2002/0088145 | A1 | | 7/2002 | Clark et al. |
| 2005/0257405 | A1 | | 11/2005 | Kilgore |

FOREIGN PATENT DOCUMENTS

| | | |
|---|---|---|
| EP | 1383402 B1 | 5/2005 |
| FR | 993 360 | 10/1951 |
| FR | 1 218 101 | 5/1960 |
| FR | 2 501 480 | 9/1982 |
| FR | 2 675 349 | 10/1992 |
| WO | WO 96/18317 | 6/1996 |
| WO | WO 01/82733 | 11/2001 |
| WO | WO 02/051273 | 7/2002 |

OTHER PUBLICATIONS

U.S. Appl. No. 60/258,184, filed Dec. 22, 2000.

Dakkak Brothers Company, Our Products: Microcellular Rubber Sheets, T.P.R.—Granules, EVA Compound, Rubber Compound [online], http: //www.dakkakco.com/productsl.html [retrieved on Jun. 7, 2001], pp. 1/3-3/3.

Acor Orthopaedic, Inc., Poron [online], http: // www. acor.com/poron.htm, [retrieved on Jun. 5, 2001], pp. 1/3-3/3.

Acor Orthopaedic, Inc., SPR [online], http: // www. acor.com/srp.htm, [retrieved on Jun. 5, 2001], pp. 1/2-2/2.

Bontex, Our Products [online], http: //bontex.com/products.html, [retrieved Jun. 4, 2001], pp. 1/2-2/2.

International Preliminary Examination Report of PCT/US01/49381 (WO 02/051273).

Case *Calzados Hergar / Exten.s and Manufacture Francaise des Chaussures ERAM* v. *TGI Paris*, 3rd Chamber, 1st Section / RG No. 06/10081, Calzados Hergar's Responsive and Recapitulative Brief No. 2—Hearing of Jul. 2, 2008 (translated excerpt).

Excerpts from first instance decision dated Nov. 25, 2008 in lawsuit Calzados Hergar / Exten.s and Manufacture Francaise des Chaussures ERAM in a French Court: TGI Paris, 3rd Chamber, 1st Section / RG No. 06/10081, involving the French part of European patent No. EP 1,383,402 which is a French counterpart to the parent of this application (see IDS of Sep. 15, 2008).

Excerpts from patentee's appeal brief dated May 23, 2009 in Appeals Court of Paris (see IDS of Sep. 15, 2008).

* cited by examiner

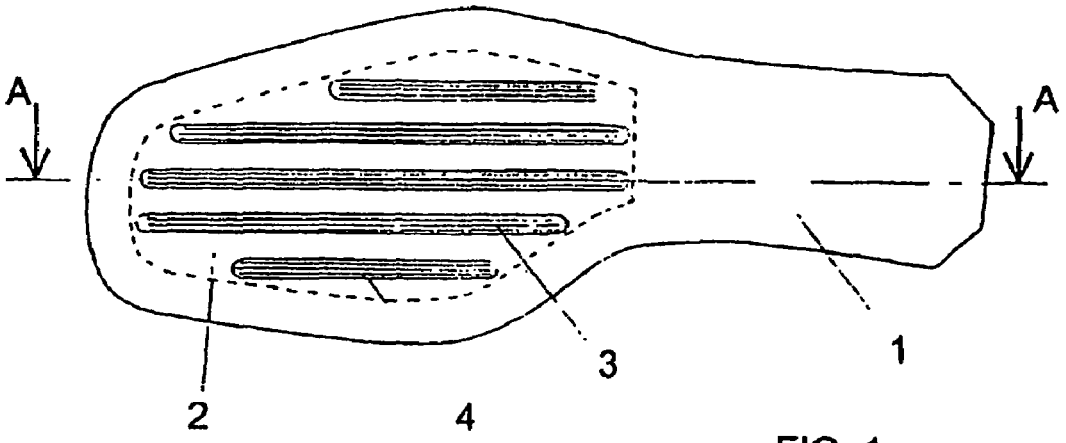
FIG. 1
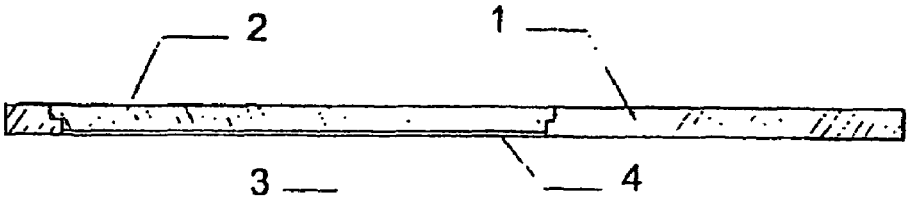
FIG. 2 - COUPE A-A

SOLE WITH EXTENSIBLE STRUCTURE

This application is a continuation of U.S. Ser. No. 10/475,933 filed Oct. 27, 2003, which is a national stage of PCT/FR02/01366 filed Apr. 22, 2002.

The present invention relates to a sole of a shoe making it possible for different foot widths to be fitted easily; it also relates to the shoe equipped with such a sole together with the method for assembling this shoe.

Usually shoes are manufactured with a width chosen by the manufacturer. This width may be bigger or smaller but it is predetermined; it does not vary as a function of the width of the wearer's foot.

It is also known how to adapt to several foot widths by manufacturing an upper part in elastic material, but without being able to enlarge the lower part in contact with the sole.

The device according to the invention makes it possible to remedy these disadvantages. In fact, according to a first specification, it comprises a sole with at least one stretchable area in the forepart of the foot; thus, when worn, the manufactured shoe fits the anatomic width of the foot on its lower part.

In the shoe sole according to the invention, the transversally stretchable forepart is obtained by moulding (or gluing), on a sole base, one or several inserts of a material with deformable structure possessing an elasticity potential and a shape memory adapted to the comfort required. This stretchable insert is flat on the upper face and provided with one or several lugs on the lower face.

These lugs are intended to be set countersunk in the base of the sole. According to another specification, the sole base is manufactured from a classic type of material such as leather, elastomer, rubber, polyurethane or any other material used traditionally for the manufacture of shoe soles and possessing the normal abrasion resistance specifications.

According to another specification, the base of the sole comprises openings intended to receive the lugs of the lower face of the stretchable insert, while still preserving the sealing of the link between the two materials. According to another specification, an insole is constituted of one or several cut-out zones in the forepart of the foot and a rigid back part.

This structure of the forepart of the insole allows transversal deformation of the forepart zone.

Other embodiments of the insole can be envisaged. The deformable part of the forepart can be made simply by juxtaposition of longitudinal slits. According to another embodiment, the deformable part of the forepart can be obtained by producing one or several longitudinal openings, these being filled or not by moulding or gluing one or several inserts of stretchable material.

The invention also concerns the footwear article equipped with the stretchable sole as described above. According to a preferred embodiment, this footwear article is constituted of an upper, the insole with a deformable forepart and a rigid back part, of a non-glued sock lining in its peripheral part and of the stretchable insert sole according to the present invention.

When the user tries on a footwear article provided with such a complex, the foot exerts pressure on the edges of the upper, causing deformation of the insole and the sole. This ability of the sole and the insole to be deformed avoids any feeling of the foot being compressed.

The method of assembling this footwear article consists of preparing an insole with a rigid back part and a deformable part in the forepart area of the foot. Using a standard width last, the upper is mounted on said insole and glued on the sole equipped with its stretchable insert. Finally, the insole is set inside the shoe.

The invention is illustrated, without being limited in any way, by the description of a preferred embodiment, provided only as an example and shown in the attached drawings in which FIG. 1 represents the sole as seen from above.

FIG. 2 shows a longitudinal section of the sole.

Figure 3:
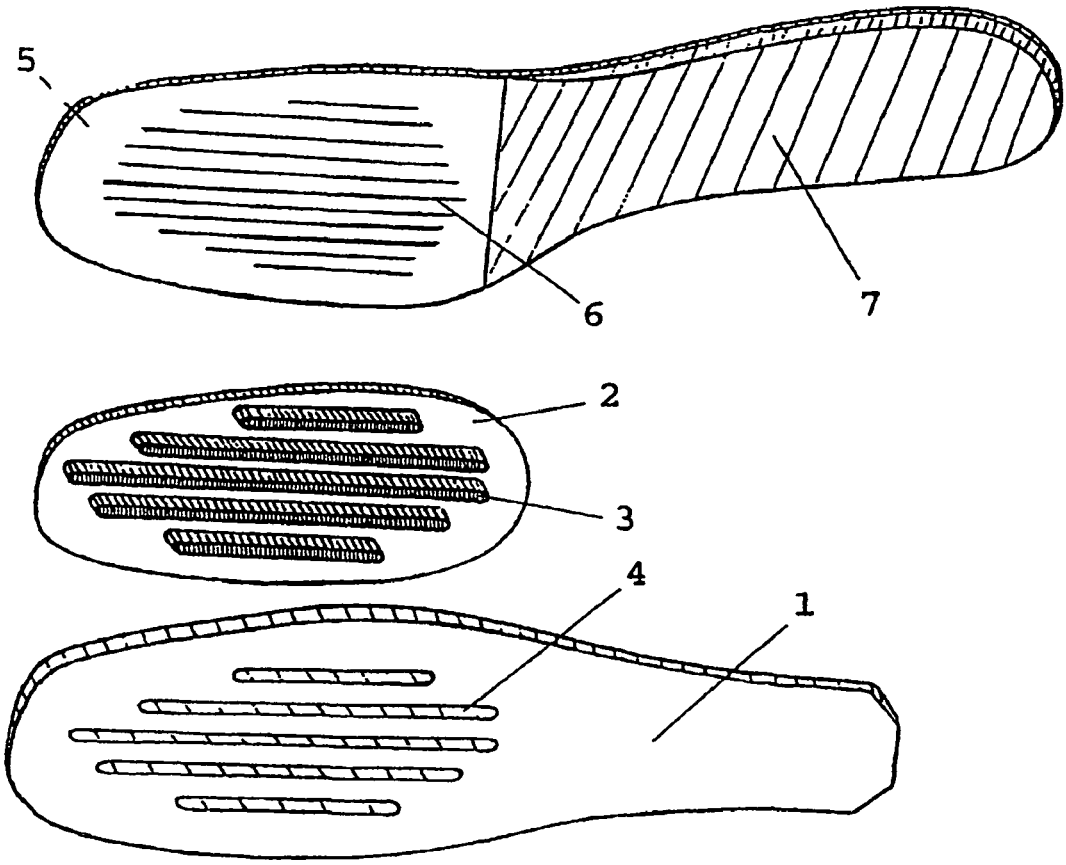
FIG. 3 shows an exploded view of the sole base, elastic insert and insole as a whole.

The sole shown in FIGS. 1 and 2 is constituted of a sole base 1 and of an insert in stretchable material 2, assembled by moulding or by gluing to ensure that there is a seal between the two materials. The lugs 3 of the stretchable insert are positioned in the openings 4 made in the base of the sole.

In the embodiment example shown, this type of implantation in parallel allows the addition of the elastic properties of each lug 3. This complex, with rigid sole base and stretchable insert makes it possible to obtain a sole that is sufficiently structured to be adapted to traditional soldering manufacture.

FIG. 3 shows a stack of independent supports with deformable and stretchable properties. The sole base 1 in rigid material is made deformable through the openings 4 made in the forepart area.

The insert 2 with lugs 3 which have been countersunk in the openings 4 of the sole base 1 is a stretchable sealed joint.

The insole 5 is equipped with a foot forepart made deformable by the presence of longitudinal slits 6 and a rigid back part 7

Figure 4:
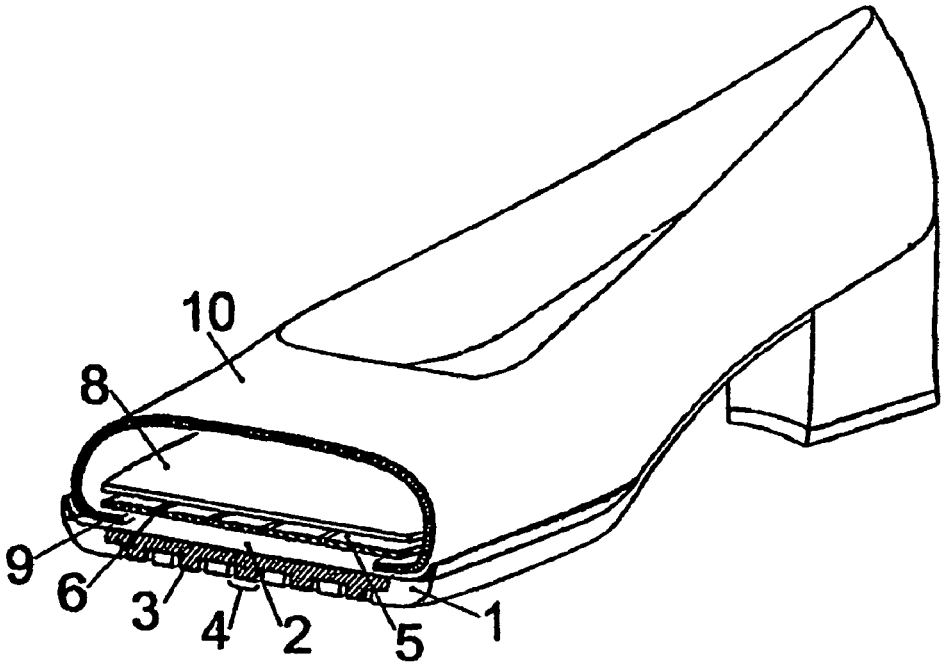
FIG. 4 shows a section in perspective of a shoe equipped with the system.

In the embodiment as a whole shown in FIG. 4, this configuration makes it possible to maintain elasticity at every stage once the assembly has been completed. The sole base 1, the insert 2 and the insole 5 possess stretchable properties outside the gluing zones 9.

The sock lining 8, non-glued at the periphery, does not block the deformation of the lower layers.

It is the pressure of the foot on the external edges of the upper 10 which produces the deformation of the superposed stretchable layers as a whole.

As a non-limiting example, the dimensions of the insert at the level of the lugs should be of the order of 3.5 mm in thickness and 7 mm in width.

It should be understood that these dimensions are only provided as indications; they can vary in function of the size and comfort required for the shoe.

This shoe structure provides walking comfort suitable, in particular, for "sensitive feet items", but evidently this stretchable structure can be envisaged for other types of assembly besides soldering or other types of footwear.

The present invention is intended, in particular, for the manufacture of shoes with the ability to adapt to varying foot widths.

The invention claimed is:

1. Footwear comprising an upper assembled with an outsole and an insole, the outsole having an outsole forepart and an outsole back part, wherein the outsole forepart is relatively deformable transversally as compared to the outsole back part, wherein the outsole comprises a sole base, wherein a forepart of the sole base is provided with at least one longitudinally oriented opening, said sole base opening being continuous and extending substantially from a toe area substantially to an arch area of the sole base, and a sole base insert mounted to the sole base, wherein the sole base insert is mounted to the sole base so as close said at least one sole base opening, the sole base insert material being relatively deformable transversally as compared to the sole base material, and the insole comprising an insole forepart and an insole back part, wherein the insole forepart is relatively deformable transversally as compared to the insole back part, wherein the deformable forepart of the insole comprises at least one of (i) a longitudinal slit or longitudinal opening, said insole slit or opening being continuous and extending substantially from a toe area substantially to an arch area of the insole, and (ii) a longitudinal opening, said insole opening being continuous and extending substantially from a toe area substantially to an arch area of the insole, said opening being filled by an insole insert of stretchable material, so that a pressure on lateral edges of the upper applied by a foot inserted in the footwear produces a transversal deformation of the superposed insole and outsole as a whole.

2. The sole footwear of claim 1, wherein the upper includes attachment zones which are glued to corresponding attachment zones of the outsole and the insole.

3. The footwear of claim 2, wherein the upper is mounted to the attachment zones of the insole and the outsole between the insole and the outsole.

4. The footwear of claim 1, wherein the insole comprises at least one longitudinal slit.

5. The footwear of claim 4, wherein the insole comprises a plurality of longitudinal slits.

6. The footwear of claim 5, wherein the slits are substantially parallel.

7. The footwear of claim 5, wherein the slits are unconnected.

8. The footwear of claim 5, wherein the insole comprises at least five substantially parallel slits.

9. The footwear of claim 1, wherein the forepart of the insole comprises at least one opening filled by the stretchable material.

10. The footwear of claim 9, wherein the insole comprises a plurality of openings filled by the stretchable material.

11. The footwear of claim 10, wherein the insole openings are filled by molding or gluing one or several inserts of stretchable material.

12. The footwear of claim 1, wherein the the sole base insert is in a stretchable material with shape memorization and is relatively stretchable transversally as compared to the sole base.

13. The footwear of claim 12, wherein the sole base insert is provided with at least one lug on its lower surface, and the at least one lug is countersunk in the at least one opening of the sole base.

14. The footwear of claim 12, wherein the sole base insert is glued or molded to the sole base.

15. The footwear according to claim 12, wherein the sole base insert is at least partially located in a recess of the sole base.

16. The footwear of claim 15, wherein a top surface of the sole base insert is flush with a top surface of the sole base.

17. The footwear of claim 12, wherein the sole base insert seals the at least one opening of the sole base.

18. Footwear of claim 1, wherein the upper includes attachment zones which are assembled to corresponding attachment zones of the outsole and the insole, and the upper is mounted to the attachment zones of the insole and the outsole between the insole and the outsole.

19. An article of footwear having lateral and medial sides, said article comprising: an upper including an instep portion for covering at least a portion of a wearer's foot and an insole portion adapted to underlay a wearer's foot, said insole portion comprising a non-stretch portion surrounding an expansion portion disposed longitudinally along said insole portion; a sole unit including an expansion element disposed longitudinally along said sole unit so as to align with said expansion portion of said insole portion; wherein said expansion portion and said expansion element have a retracted static condition to provide a narrower width to said article of footwear, and have an expanded, adjustment condition to provide a wider width and an increased internal volume to said article of footwear to cooperatively provide dynamic width adjustment.

20. The article of footwear of claim 19, wherein said sole unit comprises a cushioning midsole and a ground engaging outsole, and said midsole includes a longitudinal split to accommodate said expansion element.

21. The article of footwear of claim 19, wherein said sole unit comprises a cushioning midsole and a ground engaging outsole, and said midsole includes an integrally formed longitudinal expansion element splitting said sole unit between lateral and medial sides.

22. The article of footwear of claim 21, wherein said expansion portion comprises a stretch panel of material attached to said non-stretch portion.

23. The article of footwear of claim 19, wherein said expansion portion comprises a stretch panel of material attached to said non-stretch portion.

24. The article of footwear of claim 23, wherein said sole unit comprises a cushioning midsole and a ground engaging outsole, and said midsole includes a longitudinal split to accommodate said expansion element.

25. The article of footwear of claim 23, wherein said sole unit comprises a cushioning midsole and a ground engaging outsole, and said midsole includes an integrally formed longitudinal expansion element splitting said sole unit between lateral and medial sides.

* * * * *